US010766749B2

(12) United States Patent
Fretz et al.

(10) Patent No.: US 10,766,749 B2
(45) Date of Patent: Sep. 8, 2020

(54) PORTABLE WINCH

(71) Applicant: Warn Industries, Inc., Clackamas, OR (US)

(72) Inventors: Darren G. Fretz, Oregon City, OR (US); Adam K. Reiner, Wilsonville, OR (US); Bryan Yoder, Corvallis, OR (US); Shao-Hua Lin, Taichung (TW); Mei-Ling Cheng, Taichung (TW); Wei-Chen Lin, Taichung (TW); Timothy D. Krueger, Mulino, OR (US); Steven W. Shuyler, Clackamas, OR (US)

(73) Assignee: WARN INDUSTRIES, INC., Clackamas, OR (US)

( * ) Notice: Subject to any disclaimer, the term of this patent is extended or adjusted under 35 U.S.C. 154(b) by 693 days.

(21) Appl. No.: 14/831,720

(22) Filed: Aug. 20, 2015

(65) Prior Publication Data

US 2016/0068376 A1 Mar. 10, 2016

Related U.S. Application Data

(60) Provisional application No. 62/047,544, filed on Sep. 8, 2014.

(51) Int. Cl.
*B66D 1/22* (2006.01)
*B66D 3/00* (2006.01)
(Continued)

(52) U.S. Cl.
CPC ..... *B66D 1/22* (2013.01); *B66D 1/16* (2013.01); *B66D 1/28* (2013.01); *B66D 3/00* (2013.01); *B66D 3/18* (2013.01)

(58) Field of Classification Search
CPC ... B66D 1/16; B66D 1/22; B66D 1/28; B66D 3/00; B66D 3/18
See application file for complete search history.

(56) References Cited

U.S. PATENT DOCUMENTS 1,453,559 A * 5/1923 Webb ..... B66D 1/225 254/344
2,083,489 A * 6/1937 Benson ..... B66D 1/06 254/356

(Continued)

FOREIGN PATENT DOCUMENTS

CN 105102361 A 11/2015

OTHER PUBLICATIONS

DBI SALA, "User Instruction Manual Advanced Digital Winch," Form 8511324, Revision B, Available Online at www.capitalsafety.com, Available as Early as Sep. 10, 2007, 24 pages.
"Pulleyman USA: Features," Pulleyman USA Website, Available Online at www.pulleymanusa.com/features.html, Available as Early as May 2, 2008, 2 pages.
"Using a 1/2 Inch Drill to Raise and Lower Your Tower," WD0M's Home Page Website, Available Online at www.wd0m.com/winchadapter.html, Available as Early as Sep. 30, 2008, 3 pages.

(Continued)

*Primary Examiner* — Michael E Gallion
(74) *Attorney, Agent, or Firm* — K&L Gates LLP

(57) ABSTRACT

Methods and systems are provided for an externally actuatable pulling tool assembly. An example system may include a drum enclosing an externally actuatable input drive shaft, an output driven shaft, and a torque-limiting device positioned in-between the externally actuatable input drive shaft and the output driven shaft. The output driven shaft may be coupled to a transmission with a ring gear, the ring gear meshing with a plurality of teeth on an output end of the drum.

15 Claims, 5 Drawing Sheets

(51) Int. Cl.

| | |
|---|---|
| ***B66D 1/28*** | (2006.01) |
| ***B66D 3/18*** | (2006.01) |
| ***B66D 1/16*** | (2006.01) |

(56) References Cited

U.S. PATENT DOCUMENTS

| | | | | |
|---|---|---|---|---|
| 2,450,605 | A * | 10/1948 | McIntyre | B66D 1/06 254/345 |
| 2,630,298 | A * | 3/1953 | Hoehn | B66D 1/06 254/366 |
| 3,003,585 | A * | 10/1961 | Andersson | B66D 1/26 187/257 |
| 3,697,049 | A * | 10/1972 | Wallace | B66D 1/16 192/85.37 |
| 3,836,122 | A * | 9/1974 | Pierce, Jr. | B66D 1/14 254/273 |
| 4,196,889 | A * | 4/1980 | Dudek | B66D 1/22 254/344 |
| 4,265,142 | A * | 5/1981 | Watanabe | F16H 3/40 242/350 |
| 4,413,713 | A * | 11/1983 | West | B66D 1/14 192/14 |
| 4,736,929 | A * | 4/1988 | McMorris | B66D 1/22 254/323 |
| 4,884,784 | A | 12/1989 | Nix et al. | |
| 5,507,471 | A * | 4/1996 | Mercurio | B66C 1/18 254/134.3 R |
| 5,572,905 | A | 11/1996 | Cook, Jr. | |
| 5,595,251 | A | 1/1997 | Cook, Jr. | |
| 5,775,186 | A | 7/1998 | Rahm | |
| 7,270,312 | B1 * | 9/2007 | Phipps | B66D 1/22 254/278 |
| 7,278,808 | B1 | 10/2007 | Sisk, Sr. et al. | |
| 7,357,612 | B1 | 4/2008 | Paul | |
| 7,588,109 | B2 | 9/2009 | Wachendorf et al. | |
| 7,789,375 | B2 * | 9/2010 | Ying | B66D 1/04 254/323 |
| 7,891,641 | B1 * | 2/2011 | Miller | B66D 1/16 254/344 |
| 8,434,742 | B2 * | 5/2013 | Akhavein | B66D 3/006 254/344 |
| 9,120,655 | B2 * | 9/2015 | Wilkins | B66D 1/225 |
| 9,266,702 | B2 * | 2/2016 | Fretz | B66D 1/02 |
| 9,919,904 | B2 * | 3/2018 | Gottschling | B66D 3/18 |
| 2003/0151037 | A1 * | 8/2003 | O'Fallon | B66D 1/16 254/344 |
| 2007/0221898 | A1 * | 9/2007 | Giacomini | B66D 1/08 254/323 |
| 2008/0116430 | A1 * | 5/2008 | Elliott | B66D 1/22 254/355 |
| 2008/0246011 | A1 * | 10/2008 | Heravi | B66D 1/14 254/266 |
| 2010/0065799 | A1 * | 3/2010 | Zhou | B66D 1/22 254/344 |
| 2010/0127229 | A1 * | 5/2010 | Kverneland | B66D 1/12 254/356 |
| 2010/0133372 | A1 * | 6/2010 | Ying | B66D 1/04 242/395 |
| 2011/0215285 | A1 | 9/2011 | Akhavein et al. | |
| 2013/0056694 | A1 * | 3/2013 | Wilkins | B66D 1/225 254/342 |
| 2014/0001427 | A1 * | 1/2014 | Fretz | B66D 1/02 254/342 |

OTHER PUBLICATIONS

"GRCS: Good Rigging Control System Lowering Device," WesSpur Tree Equipment, Inc. Website, Available Online at www.wesspur.com/good-rigging-control-system/good-rigging-control-system.html, Available as Early as Jul. 27, 2009.

"4-Point Hard Top Lift," JK Forum Website, Available Online at www.jk-forum.com/forums/jk-write-ups-39/4-point-hard-top-lift-103806/, Oct. 2, 2009, 6 pages.

"2000 Lb. Capacity Geared Winch," Harbor Freight Tools Website, Available Online at www.harborfreight.com/2000-lb-capacity-geared-winch-5798.html, Available as Early as Jun. 27, 2010, 2 pages.

"Winches for Your Garage," Garage Cabinets Sense Website, Available Online at www.garagecabinetsense.com/winches-for-your-garage/, Available as Early as Jul. 6, 2010, 3 pages.

"Re: 12 Volt Winch on Feeder?," Texas Hunting Forum Website, Available Online at http://texashuntingforum.com/forum/ubbthreads.php/topics/1550093/Re_12_volt_winch_on_feeder, Jul. 23, 2010, 4 pages.

"Drill Drive Winch System Model 1055 for Panellift(R)," Contractors Solutions Website, Available Online at www.contractors-solutions.net/Drill-Drive-Model-1055-for-Panellift-P495.aspx, Available as Early as Jun. 30, 2011, 2 pages.

"Battery Baby Winch—Chizong Machine Co., Ltd.," Duke Winch/Taiwan Trade Website, Available Online at http://duke-winch.en.taiwantrade.com.tw/product/battery-baby-winch-517969.html, Available as Early as Feb. 3, 2012, 2 pages.

"Electric Mini Wire Winch DU-160A—Chizong Machine Co., Ltd.," Duke Winch/Taiwan Trade Website, Available Online at http://duke-winch.en.taiwantrade.com.tw/product/electric-mini-wire-winch-du-160a-419300.html, Available as Early as Aug. 15, 2012, 2 pages.

"Building the Capability for One Person, Without Assistance, to Move Hammond Organs and Leslie Speakers in and Out of a Fourth-story, Walkup Apartment," One-Man Organ Move Website, Available Online at http://spinetorganmove.homestead.com/, Available as Early as May 16, 2013, 1 page.

"Worm Gear Winch WA200 GR/D-Kwint," Zeker Van Kwint Website, Available Online at http://kwintgroep.com/hoist-lifting-equipment/hand-winches/worm-gear-winch-wa200-grd/, Available as Early as Jun. 13, 2013, 5 pages.

"DPX Systems Drill Powered Winch," DPX Systems Website, Available Online at www.dpxsystems.com/shopping/dpx-systems-universal-winch/, Available as Early as Jul. 19, 2013, 2 pages.

"4 Element SteppIR Installation at K8NY—Nov. 2010," K8Ny Website, Available Online at http://k8ny.com/SteppIR/SteppIR.htm, Available as Early as Oct. 11, 2013, 4 pages.

"2000 Lb. Marine Electric Winch," Harbor Freight Tools Website, Available Online at www.harborfreight.com/2000-lb-marine-electric-winch-61237.html, Available as Early as Jul. 14, 2014, 2 pages.

English translation of Chinese Office Action for related Chinese Application No. 201510568179.5; action dated Aug. 28, 2018; (15 pages).

Chinese Office Action for related Chinese Application No. 201510568179.5; action dated Jun. 26, 2019; (11 pages).

Chinese Office Action and English translation for related Chinese Application No. 201510568179.5; action dated Apr. 3, 2020; (32 pages).

* cited by examiner

PORTABLE WINCH

CROSS REFERENCE TO RELATED APPLICATIONS

The present application claims priority to U.S. Provisional Patent Application No. 62/047,544, "PORTABLE WINCH," filed on Sep. 8, 2014, the entire contents of which are hereby incorporated by reference for all purposes.

TECHNICAL FIELD

The present application relates to a portable pulling tool that can be actuated by an external source.

BACKGROUND AND SUMMARY

Heavy and cumbersome objects may need to be lifted and/or moved around garages, construction sites, farms, etc. As such, these objects may be heavy enough to require the use of equipment such as winches, hoists, or alternate pulling tools for moving and/or lifting. However, moving and hoisting equipment may be electrically operated and access to electricity may not be easily available at all sites. Accordingly, battery operable and/or externally actuatable moving and hoisting equipment may be desirable.

One example system for an externally actuatable winch is shown by Ying in U.S. Pat. No. 7,789,375. Herein, a portable winch assembly includes a planetary reduction gearbox with a primary sun gear configured to be coupled to and driven by a handheld torquing device such as an electric drill. Other than the primary sun gear, the planetary reduction gearbox further includes a first set of planet gears driven by the primary sun gear as well as a second set of planet gears driven by a secondary sun gear. The rotation of the primary sun gear and the planetary gear system enables rotation of a drum with a cable.

The inventors herein have identified potential issues with the above example system. Specifically, the portable winch assembly in U.S. Pat. No. 7,789,375 may be exposed to mechanical overload and resulting degradation. For example, torque provided by the handheld torquing device to the portable winch assembly may be amplified by the planetary reduction gearbox. The amplified torque may exceed structural design parameters of the portable winch assembly resulting in mechanical degradation of the assembly and its components. In addition, incorporating two sets of planetary gears for providing gear reduction may increase manufacturing costs of the portable winch assembly leading to higher costs for the consumer.

The inventors herein have recognized the above issues and identified various approaches to at least partly address the above issues. In one example approach, a system for a pulling tool is provided comprising a drum having an output end, an externally actuatable input shaft, an output driven shaft, a torque-limiting device positioned within the drum, the torque-limiting device including a torque-limiting mechanism situated between the externally actuatable input shaft and the output driven shaft, and a transmission including an input and a ring gear, the input coupled to the output driven shaft and the ring gear coupled to the output end of the drum. In this way, a pulling tool may be powered by external actuation while reducing incidences of torque overload.

For example, a pulling tool assembly may include a drum for winding a cable or wire rope. The drum may be positioned between a first end housing and a second end housing, and an output end of the drum may be configured with splined teeth. The drum may in turn include a torque-limiting device positioned within a spool of the drum. The torque-limiting device may include a torque limiter situated between an input drive shaft and an output driven shaft. The input drive shaft may be actuatable by an external actuator and may transmit applied torque to the output driven shaft via the torque limiter. The output driven shaft, in turn may be coupled to an input of a transmission. In one example, the input of the transmission may comprise a sun gear of a planetary gear set. Further, the transmission may include a differential planetary gear system. The transmission may further include a rotatable ring gear that meshes with the splined teeth on the output end of the winch drum. Rotational torque may be transmitted from the external actuator via the input drive shaft and output driven shaft to the transmission which in turn drives the drum to either release or retract the cable.

In this way, a pulling tool assembly may be actuated by an external device while reducing a likelihood of mechanical degradation by torque overload. By positioning the torque-limiting device between the input drive shaft and the output driven shaft, torque greater than a predetermined threshold may not be relayed to the transmission. Thus, the transmission may experience less degradation. Further, the pulling tool assembly may be operated as a handheld device as the torque-limiting device may reduce potential of torque overload. By using only a single set of differential planetary gears for torque amplification, the pulling tool assembly may have reduced manufacturing costs. Additionally, by not providing a motor within the pulling tool assembly and by using a planetary gear set and not a separate braking device, costs may be further reduced enabling the pulling tool assembly to be more affordable to a consumer.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 2:
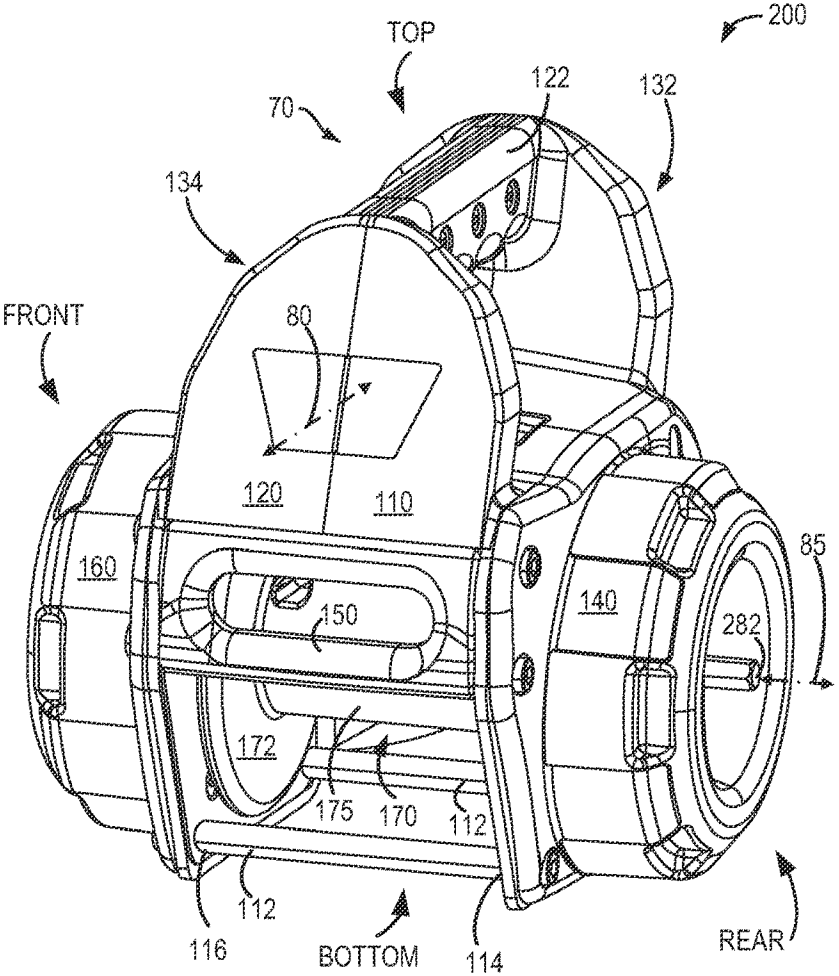
FIG. 2 depicts a perspective view of the example pulling tool assembly of FIG. 1 as viewed from a side.
Figure 3:
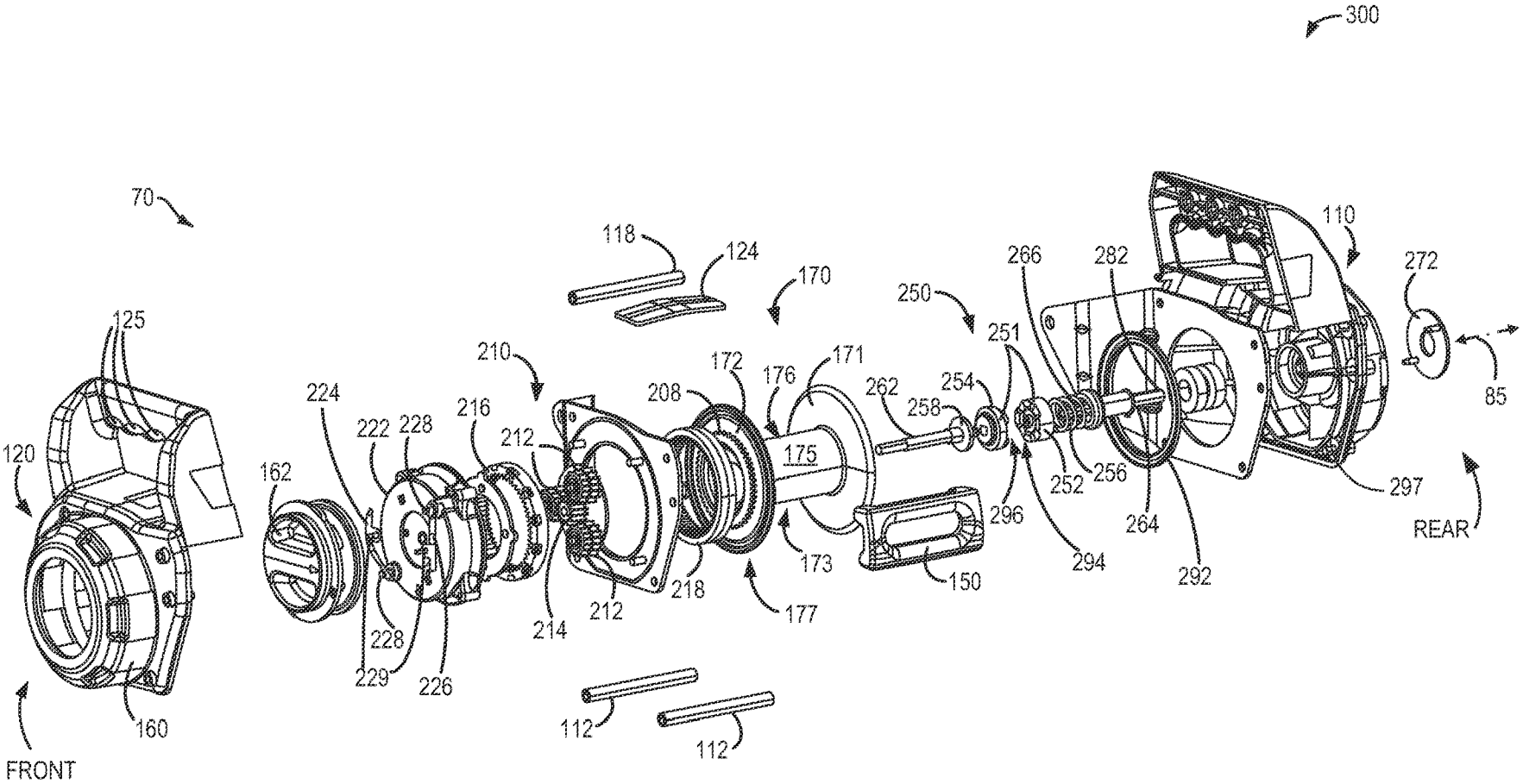
FIG. 3 illustrates an exploded view of the example pulling tool assembly of FIG. 1.
Figure 4:
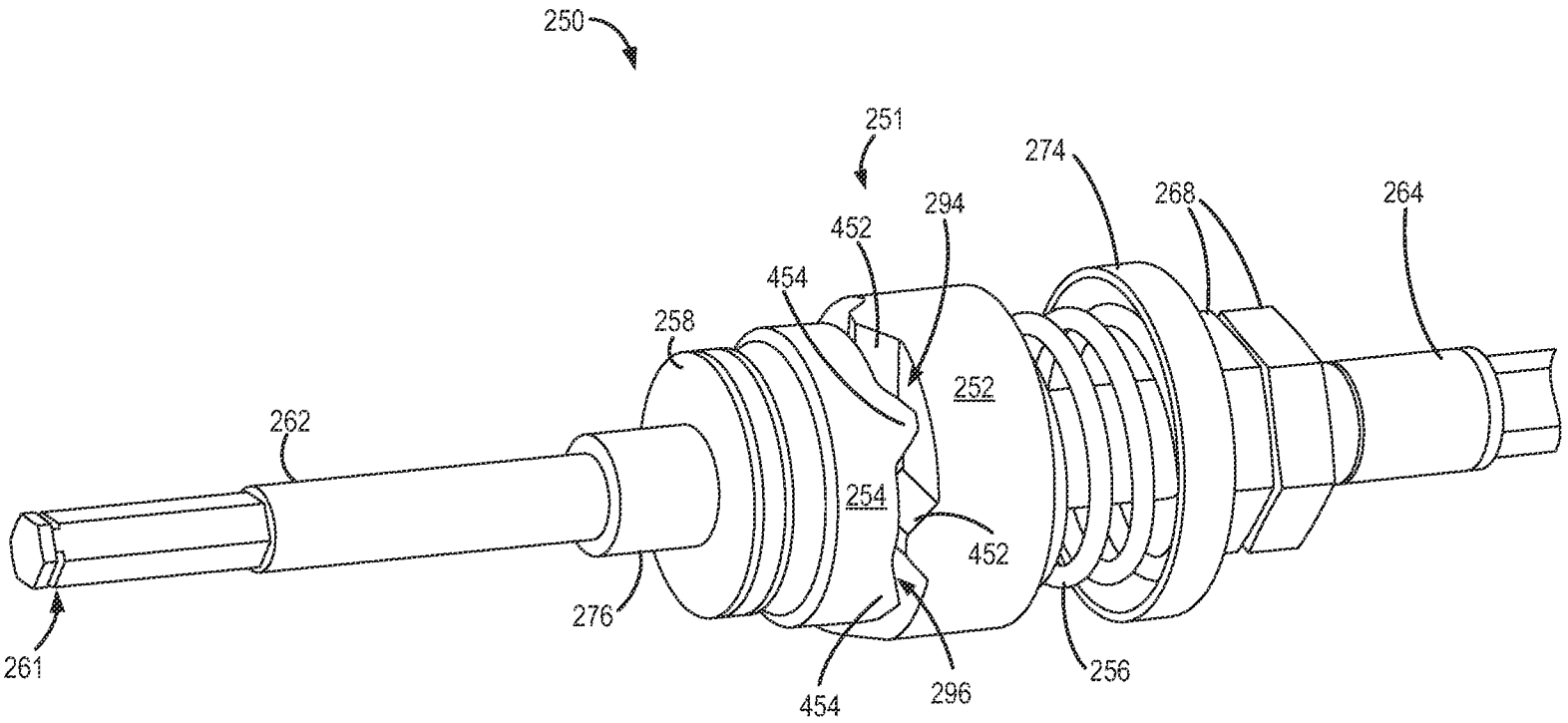
FIG. 4 portrays a perspective view of a torque-limiting device within the example pulling tool assembly of FIG. 1.
Figure 5:
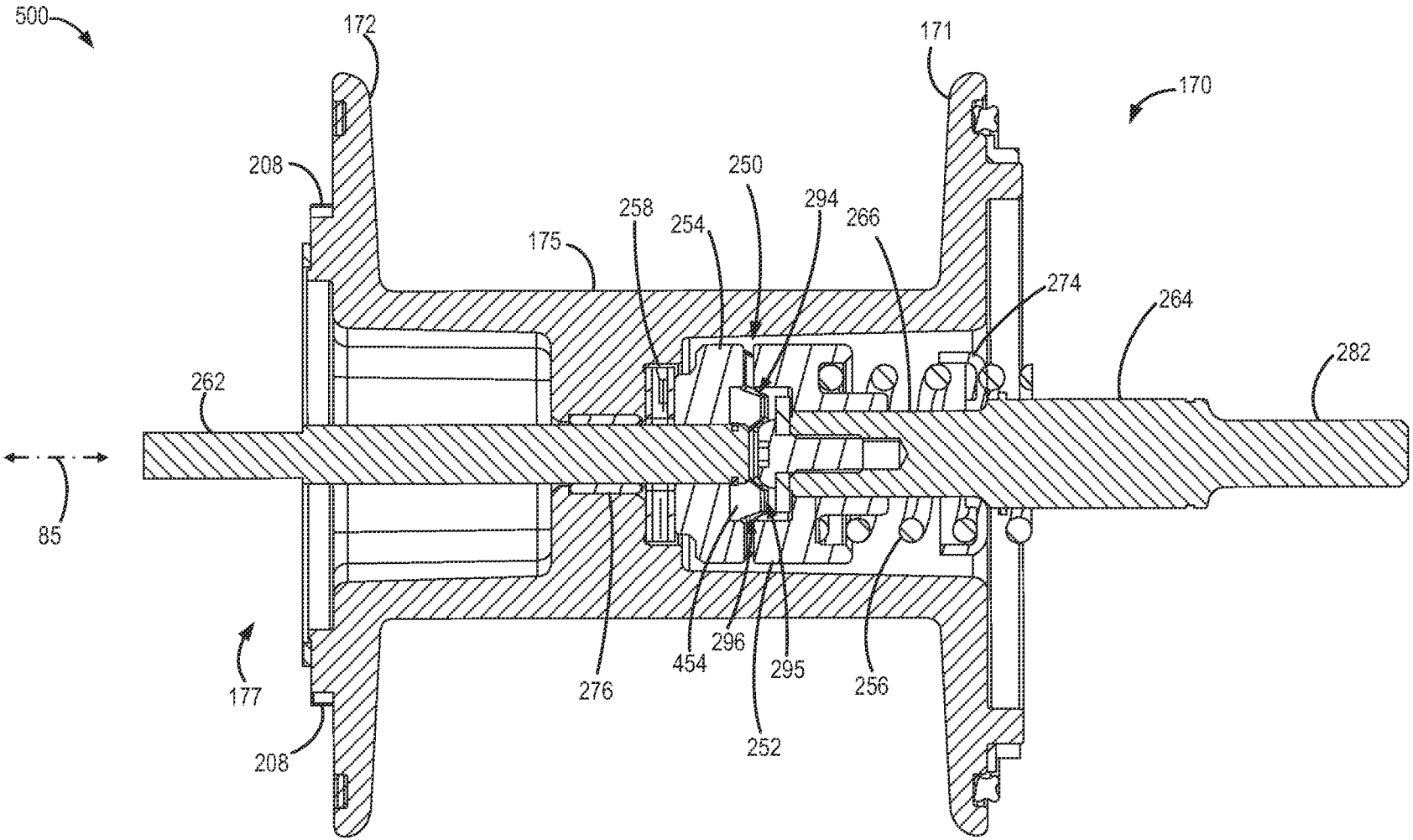
FIG. 5 depicts a sectional view of a pulling tool drum within the example pulling tool assembly of FIG. 1, according to the present disclosure.
Figure 7:
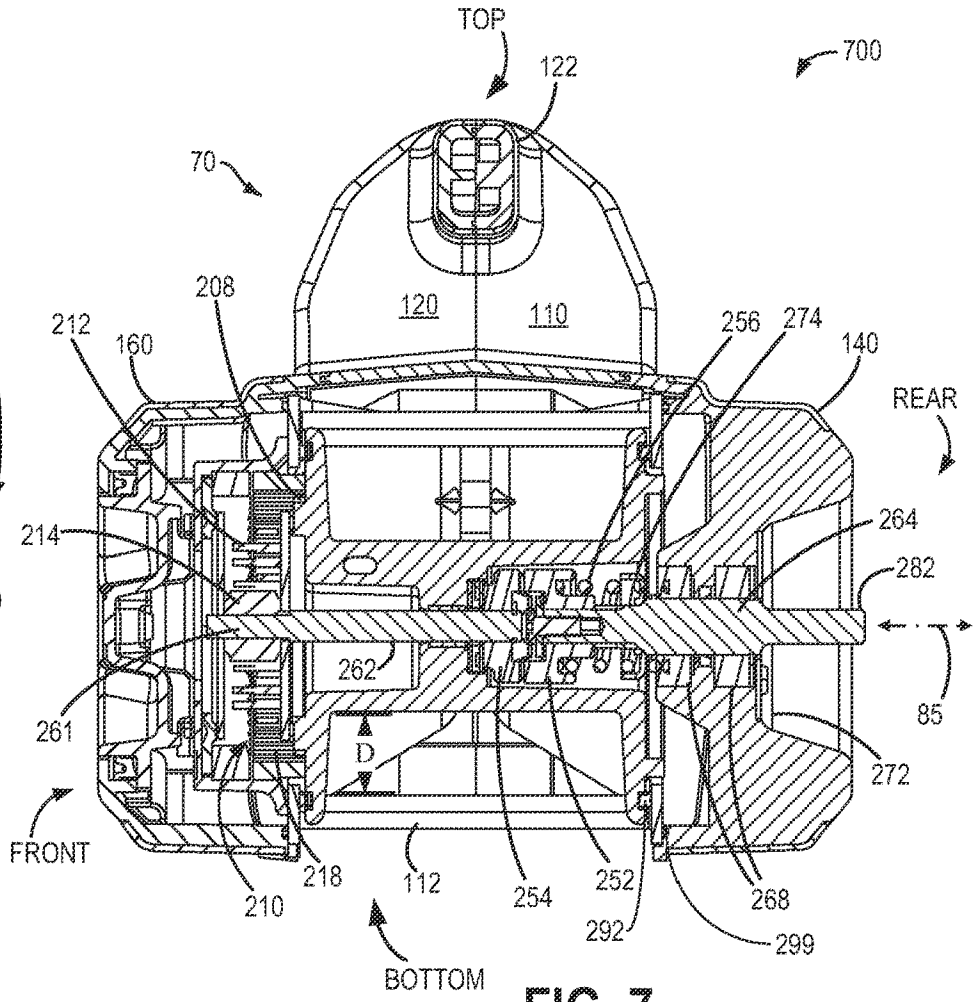
FIG. 7 presents a cross-sectional view of the example pulling tool assembly of FIG. 6.

The following detailed description provides information regarding a pulling tool assembly, such as the example pulling tool assembly of FIGS. 1-7, actuatable by an external actuator. The pulling tool described herein could be a variety of pulling tools including, but not limited to, a winch, as hoist, or an alternate pulling tool. Thus, while a winch may be described below, it should be noted that this is an example of a pulling tool and may also be used as a hoist or another type of pulling tool. The pulling tool assembly may include a drum positioned between two end housings (as shown in FIG. 7), and a torque-limiting device may be situated within a spool of the drum (as shown in FIG. 5). The torque-limiting device may be positioned between an externally actuatable input shaft and an output driven shaft (as shown in FIG. 4). Further, the output driven shaft may drive a planetary gear transmission, which in turn may drive the drum (as shown in FIG. 3). The pulling tool assembly may be used as a handheld tool or may also be attached to an external structure for stronger support when desired.

Regarding terminology used throughout this detailed description, torque-limiting device may also be referred to as a torque limiter or an overload limiter. Further, the drawings shown in FIGS. 1-7 are drawn approximately to scale. Further, the pulling tool may also be referred to herein as a winch or hoist.

Figure 1:
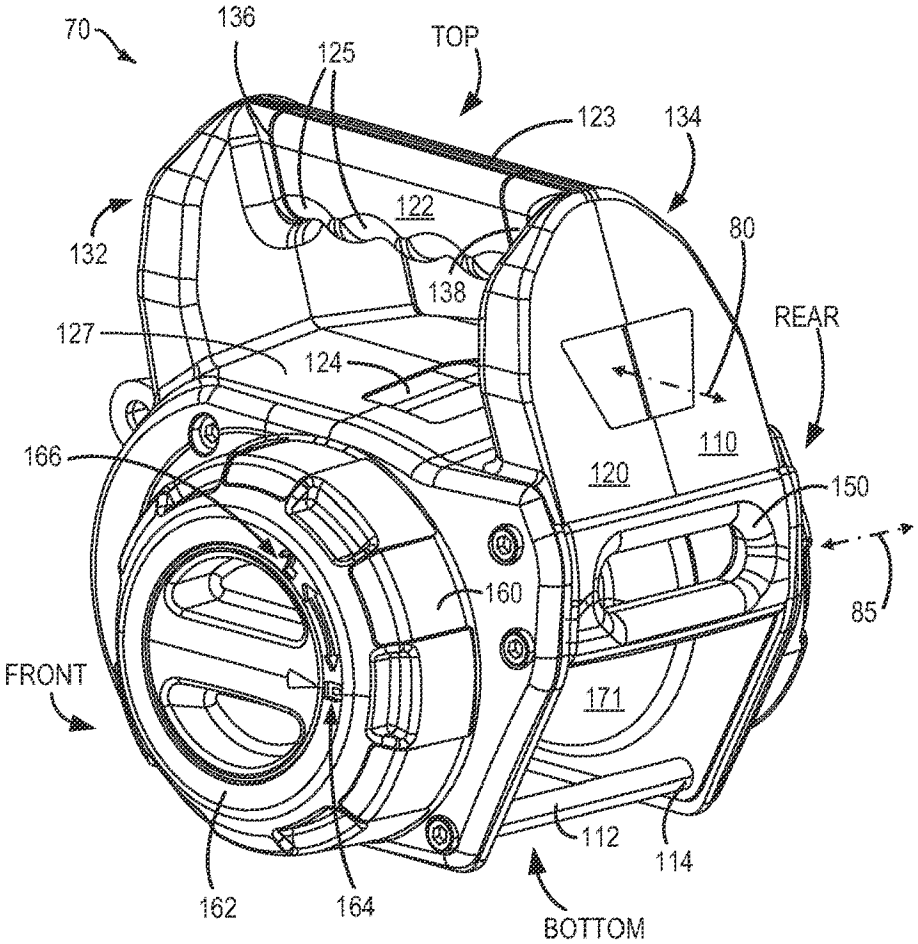
FIG. 1 shows a perspective view of an example pulling tool assembly as viewed from front, in accordance with the present disclosure.

FIG. 1 depicts a perspective view of an example pulling tool (e.g., winch) assembly 70 (also termed winch 70, herein). Specifically, perspective view 100 in FIG. 1 illustrates a view from a front end of winch assembly 70. FIG. 2 depicts a perspective view 200 as observed from a first side of the winch assembly 70. A description of FIGS. 1 and 2 follows below.

Winch assembly 70 includes two end housings comprising a first end housing 110 and a second end housing 120 which may be mechanically coupled together. Coupling methods may include joining the first end housing 110 to second end housing 120 via bolts, rivets, screws, or other methods. The two end housings 110 and 120 may be coupled such that they may be dis-assembled for repair and/or replacement. It will also be noted that first end housing 110 and second end housing 120 may include additional components that may not be described in detail herein.

As depicted in FIGS. 1 and 2, the first end housing 110 is situated opposite the second end housing 120, with respect to a centerline 80 of the winch assembly 70, the centerline 80 being perpendicular to an axis of rotation 85 of the winch 70 (also referred to herein as a rotational axis or drum axis of the winch 70). The first end housing 110 forms a rear end of the winch assembly 70 and second end housing 120 forms a front end of the winch assembly 70. A winch drum 170 is located within winch assembly 70. Specifically, winch drum 170 may be positioned between first end housing 110 and second end housing 120. However, winch drum 170 may be exposed towards its bottom surface. As such, winch drum 170 may be at least partially enclosed within the two end housings 110 and 120. Winch drum 170 may comprise a first flange 171, a second flange 172, and a spool 175.

Winch 70 may be a portable handheld device that may be gripped via handle 122. As shown in FIGS. 1-2, the handle 122 may include a series of ridges 125 on a bottom surface facing toward the winch drum 170, the ridges 125 formed to fit a user's fingers. Handle 122 may comprise a top flat portion 123 situated opposite the ridges 125 formed as finger holds. First end housing 110 and second end housing 120 may form a first inclined portion 132 and a second inclined portion 134 towards the top of winch assembly 70. Handle 122 may be coupled in-between first inclined portion 132 and second inclined portion 134. As such handle 122 may be attached to first inclined portion 132 at first end 136 and may be attached to second inclined portion 134 at second end 138. First inclined portion 132 and second inclined portion 134 may be inclined in a direction parallel to centerline 80. Handle 122 may, accordingly, extend from second inclined portion 134 to first inclined portion 132 in a direction parallel to centerline 80. Further, first inclined portion 132 may angle away from second inclined portion 134 while second inclined portion 134 may be inclined towards first inclined portion 132. As such, each of first inclined portion 132 and second inclined portion 134 incline away from a fairlead 150 which will be described below.

Figure 6:
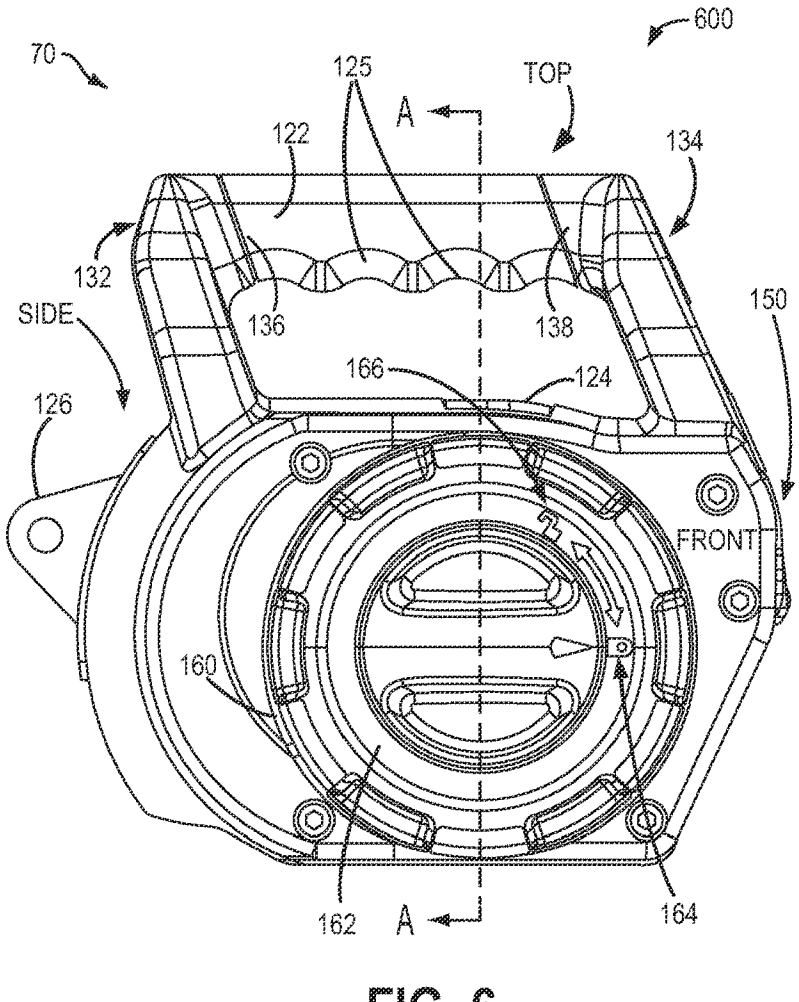
FIG. 6 shows a front view of the example pulling tool assembly of FIG. 1.

As shown in FIGS. 1-2, the handle 122 is positioned directly above the drum 170. More specifically, the handle 122 is positioned at the centerline 80 and is centered along the drum axis 85. Said another way, the handle 122 is positioned at the center of the winch, with respect to the drum axis 85, and is thus centered over a center of the drum 170. Further, the handle is positioned over a center of gravity of the pulling tool. For example, as seen in FIG. 6 and described further below, a center portion of the handle 122 is shifted (e.g., angled) toward a back of the pulling tool. In this way, the handle 122 allows the winch to be handheld and the central positioning of the handle 122 keeps the winch level when being held and operated by a user.

As an alternative to being a handheld device, winch 70 may be mounted on or attached to an external support. As shown in FIGS. 1 and 2, a plurality of tie rods 112 are situated towards a first surface of the winch 70. For example, the first surface of winch 70 may be a bottom surface (as shown in FIGS. 1 and 2). Herein, the bottom surface may be below winch drum 170. A strap or similar connecting device may be attached or hooked to the plurality of tie rods 112, thereby enabling mounting of or attaching of winch 70 onto a support structure. In the embodiment of FIGS. 1 and 2, the plurality of tie rods 112 are located proximate to the bottom of the winch 70, below the winch drum 170. Further, the plurality of tie rods 112 are positioned proximate to a bottom of an interior surface of the two end housings 110 and 120. The depicted embodiment includes two tie rods arranged below winch drum 170. The two tie rods 112 at the bottom of winch assembly 70 substantially form a bottom surface of the winch 70. While two tie rods 112 are shown in the given example, in other examples, a higher number or lower number of tie rods may be used.

As observed from FIG. 2, the plurality of tie rods 112 are spaced away from each other and are also spaced a distance from a bottom side of spool 175 of winch drum 170, the bottom side (173 of FIG. 3) of spool 175 opposite a top side (176 of FIG. 3) of spool 175, the top side (176 of FIG. 3) closer to the handle 122 than the bottom side (173 of FIG. 3). By arranging the plurality of tie rods 112 with substantial space between each other, and at substantial distance from a bottom side of spool 175 of winch drum 170, the plurality of tie rods 112 may be accessible for easier attachment to an external support. To elaborate, each of plurality of tie rods 112 may be spaced away from each other such that an opening is formed at a bottom of the winch 70 between the two tie rods 112, as shown in FIG. 2. It will be appreciated that the plurality of tie rods 112 may not have any other component included between each other. In other examples, additional tie rods may be placed between the two depicted tie rods 112. Further, each of plurality of tie rods 112 may be spaced away from and below the base (or bottom surface) of spool 175 of winch drum 170. No other component may be located between a tie rod and the base of the winch drum. Thus, the positioning of the plurality of tie rods away from each other, and at a distance from the bottom surface of the winch drum 170 enables ease of access for hooking a strap or a cable from an external support. Other embodiments may position the plurality of tie rods at different locations than shown in FIGS. 1 and 2.

The plurality of tie rods 112 may be coupled to each of the two end housings 110 and 120. In one example, mechanical coupling methods may be utilized. Mechanical coupling methods may include joining via bolts, nuts, screws, rivets, etc. As such, each of the plurality of tie rods 112 may extend from the first end housing 110 to the second end housing 120, and vice versa. To elaborate, each of the plurality of tie rods may have a first end 114 and a second end 116. The first end 114 of each tie rod 112 may be attached to first end housing 110, and the second end 116 of each tie rod 112 may be joined to second end housing 120. Each of the plurality of tie rods 112 may be cylindrical. Alternatively, the plurality of tie rods 112 may have rectangular, square, or another cross section. In other embodiments, the tie structures 112 may be of different shapes including being thinner or thicker than depicted in FIGS. 1 and 2.

In addition to the plurality of tie rods 112 that may be used for securing winch assembly 70 to an external support, winch 70 may also include an anchor fixture (not indicated in FIGS. 1 and 2) for connecting winch 70 to the external support. Anchor fixture will be described in more detail in reference to FIG. 6 below.

As shown in FIGS. 1-2, a fairlead 150 is located on a side of winch 70 between the first end housing 110 and the second end housing 120. Fairlead 150 may be coupled to each of the two end housings via one of several fastening methods including bolting, riveting, etc. Other coupling methods may also be used. Fairlead 150 is a distinct structural member of the winch assembly 70. As such, fairlead 150 guides movement of a cable or wire rope as it is wound onto or unwound from a winch drum in the winch assembly. As shown in FIGS. 1 and 2, fairlead 150 extends from first end housing 110 to second end housing 120 in a direction parallel to the axis of rotation 85. Accordingly, fairlead 150 may define a distance between first end housing 110 and second end housing 120. Further, fairlead 150 includes a central opening (e.g., centrally positioned between an inner surface of the first end housing 110 and an inner surface of the second end housing 120) for passage of the cable or wire rope there through. Edges of the fairlead 150 surrounding the central opening may be chamfered (e.g., curved away from an interior of the winch) to provide a smoother surface and reduce wear on the cable as the cable passes through the central opening. The width of the opening of the fairlead 150 (e.g., in a direction of a long axis of the fairlead that extends from the front to rear end) is approximately the same as the width of the spool 175. Additionally, the fairlead 150 may be made of cast iron with radius edges for greater wear resistance against the winch rope. Additionally, the curved edges and opening of the fairlead allows for proper spooling of the rope on the drum 170. The fairlead height is narrow enough to keep a hook which may be coupled to an end of the rope from being pulled into the tool/drum. Further, as best seen in FIG. 5, described in further detail below, the drum 170 has a large amount of freeboard (e.g., the distance between the drum or top layer of rope wound around the drum and the outside of the drum flanges 171 and 172. Additionally, the center of the opening of the fairlead 150 is positioned vertically above the axis of rotation 85 of the drum 170. As such, the fairlead 150 is positioned closer to a top surface 127 of the winch 70 than the bottom surface formed by the tie rods 112. As explained further below, the top surface 127 is positioned between the winch drum 170 and the handle 122.

Second end housing 120 includes a front circular frame end 160 (e.g., first end cap) which in turn may include a rotatable dial 162. Winch 70 may be unlocked by rotating dial 162 between a locked position 164 and an unlocked position 166. When in the locked position, winch assembly 70 may not be back-drivable so that a load may be held when external actuation is stopped. To release the load and enable free spooling, winch assembly 70 may be unlocked by rotating dial 162 to unlocked position 166.

A window 124 may also be included on the top surface 127 of winch assembly 70 for viewing cable movement and spooling. The window 124 may be formed across the top, outward-facing surface, with respect to the winch drum 170. For example, window 124 may be positioned in the top, outward-facing surface of both the first end housing 110 and the second end housing 120. As such, the window 124 extends across the top, outward-facing surface, in a direction of the axis of rotation of the winch 70, from the first end housing 110 to the second end housing 120. In this way, the window 124 may be positioned above the winch drum 170 in order to allow a user to view the winch drum 170. Window 124 may also be situated underneath handle 122 and between first inclined portion 132 and second inclined portion 134. As such, the window 124 is positioned between the drum 170 and the handle 122. The window 124 allows the winch drum 170 to be readily visible to user, while at the same time protecting a user's fingers when gripping the winch via the handle 122.

First end housing 110 includes a rear circular frame end 140 (e.g., second end cap) which may be configured with a central circular opening. A portion of an externally actuatable input drive shaft may project outwards through central circular opening of rear circular frame end 140. As shown in FIG. 2, second end 282 of externally actuatable input drive shaft 264 (not shown in FIGS. 1 and 2) protrudes outside of a rear portion of winch assembly 70 where it may be coupled to an external actuator, e.g. a battery powered drill.

Thus, an example assembly for a portable winch may comprise two end housings coupled to each other. A winch drum may be positioned within the two end housings wherein the winch drum includes an input side and an output side. A plurality of tie rods may be mechanically coupled to the two end housings and the plurality of tie rods may be positioned around a first side (e.g. bottom side) of the winch drum. Further, a fairlead may be located between the two end housings and may be coupled to each of the two end housings. The example assembly may also include a space between the tie rods and a bottom surface of the winch drum allowing access for hooking the tie rods to a support. Furthermore, the example assembly may also comprise an anchor fixture to attach the portable winch to an external support. As will be explained below, a torque limiting device or a torque limiter may also be included inside the winch drum of the example assembly.

Turning now to FIG. 3, it shows an exploded view 300 of winch assembly 70. First end housing 110 towards the rear end of winch assembly 70 is shown towards the extreme right hand side of exploded view 300. Second end housing 120 with front circular frame end 160 towards the front end of winch assembly 70 is shown at the extreme left hand side of the exploded view 300. Various components that may be enclosed within the two end housings 110 and 120 are portrayed in between. It will be noted that all components that are depicted in exploded view 300 may not be described.

As mentioned earlier in reference to FIGS. 1 and 2, winch 70 may include winch drum 170 which comprises first flange 171, second flange 172, and spool 175. Second flange 172 may include an output end 177 of winch drum 170. As will be observed, output end 177 of winch drum 170 has a plurality of teeth 208. Plurality of teeth 208 may also be termed splined teeth 208 herein. Plurality of teeth 208 may be cast onto the output end 177 of the winch drum 170, or alternatively may be machined onto the output end 177. Winch 70 also includes transmission 210. In the example shown, the transmission 210 is a differential planetary gear train system. Transmission 210, therefore, may comprise sun gear 214, a plurality of planet gears 212, a fixed ring gear 216, and a rotatable ring gear 218. The planet gears 212 may be affixed between carrier plates (not indicated). Further, each of the plurality of planet gears 212 may include two sets of teeth formed in a stepped manner. A first set of teeth on each of the plurality of planet gears 212 may mesh with fixed ring gear 216 while a second set of teeth on each of the plurality of planet gears 212 may mesh with rotatable ring gear 218. It will be appreciated that fixed ring gear 216 and rotatable ring gear 218 may have a different number of teeth. Rotatable ring gear 218 of transmission 210 may engage plurality of teeth 208 on the output end 177 of winch drum 170. Thus, torque provided to an input (sun gear 214) of transmission 210 may be transmitted to winch drum 170 via rotatable ring gear 218 meshing with splined teeth 208 on winch drum 170.

Transmission 210 may receive input torque from an output driven shaft 262 which may be coupled via a torque-limiting device 250 to input drive shaft 264. Torque-limiting device 250 may include a torque-limiting mechanism 251 which will be described later. The input drive shaft 264 is actuatable by an external actuator. In one example, the external actuator may be a handheld battery powered actuator. Second end 282 of input drive shaft 264 is adapted to be coupled to the external actuator, and thus, may receive torque from the external actuator when the external actuator is coupled to the second end 282.

At least a portion of input drive shaft 264 located opposite second end 282 may be splined. As shown in FIG. 3, a first end 266 of input drive shaft 264 is splined. As such, the splined portion of first end 266 of input drive shaft 264 may fit into torque-limiting device 250. Torque-limiting mechanism 251 of torque-limiting device 250 may include a first cam 252 and a second cam 254, which may be held together by a compression spring 256. Specifically, splined portion of first end 266 of input drive shaft 264 may fit into first cam 252 of torque-limiting mechanism 251. Output driven shaft 262 may be attached to second cam 254 and also may be supported by needle bearing 258. In the depicted example, output driven shaft 262 may be a d-shaft. First cam 252 and second cam 254 may interlock with each other enabling transmission of torque from input drive shaft 264 to output driven shaft 262. Further details of the torque-limiting device 250 will be explained below in reference to FIG. 4.

The input drive shaft 264, torque-limiting device 250 (or overload limiter 250), and output driven shaft 262 may be substantially enclosed within winch drum 170. Specifically, spool 175 of winch drum 170 may completely surround torque-limiting device 250, and substantially enclose the input drive shaft 264 and output driven shaft 262. For example, a significant portion of each of the input drive shaft 264 and output driven shaft 262 may be situated within spool 175 of winch drum 170 while a relatively smaller portion of each of the two shafts may protrude outside of spool 175. As will be shown and described in reference to FIG. 5, at least a portion of input drive shaft 264 may extend outside of winch drum 170 to enable coupling with an external actuator. Further, a section of output driven shaft 262 may project outwards of winch drum 170 to provide coupling with transmission 210. In contrast to the input drive shaft 264 and output driven shaft 262, torque limiting device 250 may be fully enclosed within spool 175 of winch drum 170.

Torque from the external actuator may be used to rotate winch drum 170 to enable winding and unwinding of a cable. The external actuator, such as a battery powered drill, may be coupled to second end 282 of input drive shaft 264. Upon actuation of the external actuator, input drive shaft 264 may rotate (e.g., rotate with rotation of the external actuator) and in turn transmit applied torque to output driven shaft 262 via torque-limiting device 250. To elaborate, input drive shaft 264 may drive first cam 252, which being interlocked with second cam 254 may drive second cam 254. Output driven shaft 262 may then be propelled by second cam 254. The rotation of output driven shaft 262 may be transmitted to sun gear 214 of transmission 210. Sun gear 214 may then drive the plurality of planet gears 212 which may transmit their rotation to rotatable ring gear 218. Winch drum 170 may then be rotated as the plurality of teeth 208 mesh with rotatable ring gear 218.

As one example, the input drive shaft 264 and drum 170 are arranged so that they turn clockwise to power the winch in (e.g., wind a rope or cable into and around the drum). For example, if the external actuator is a drill, the drill turns clockwise, thereby rotating the input drive shaft 264 and, as a result, the drum, clockwise. Since drills have a performance bias in the clockwise direction, powering the winch in, in the clockwise direction, may provide an increased amount of input torque. As a result, the winch rope or cable is powered into and wound around the drum via the power from the drill. In this way, the winch does not include a motor or another type of internal power source inside the winch. Instead, the winch drum is powered by the external power source. Further, the clockwise direction of the winch power-in operation allows the rope to be wound onto the drum at the top of the drum. Further, the arrangement of the input drive shaft 264 at the rear side of the winch allows for a left side input when being held by a user. For example, during winch operation, a user may hold the winch via the handle 122 with their right hand while they hold the external drive source (e.g., drill) with their left hand against the input drive shaft 264. In this way, the user may stand behind the winch (e.g., opposite the fairlead), so that the fairlead faces away from the user and is exposed to whatever is being pulled or hoisted. As such, the relative arrangement of the fairlead, handle, and input drive shaft 264 provides for a winch that is easier to hold and operate. In an alternate embodiment, the input drive shaft 264 and drum 170 may be arranged so that they turn counterclockwise to power the winch in.

It will be appreciated that transmission 210 in winch assembly 70 may not be back-drivable. For example, transmission 210 may not be back-driven due to a high ratio in the differential planetary transmission which enables a higher back driving friction. Herein, fixed ring gear 216 may also be attached to second end housing 120 to provide a reaction force load path and to reduce free-spooling. Fixed ring gear 216 may be coupled to second end housing 120 such that it restrains a reverse rotation of transmission 210 including the differential planetary gear train and therefore, the winch drum 170.

Instead, reverse rotation, or free-spooling, of the winch drum may be enabled by a clutch and clutch lock mechanism. For example, reverse rotation of winch assembly 70 may be enabled by unlocking fixed ring gear 216 from clutch housing 222. Referring to FIGS. 1 and 3, dial 162 may be rotated to unlocked position (e.g., free spool position) 166 so that each of spring pins (e.g., clutch pins) 228 may be raised from their respective position within leaf springs 224 and 226. By raising spring pins 228 to transition into the free spool position, the fixed ring gear 216 may be uncoupled from clutch housing 222 enabling a reverse rotation and free spooling of winch assembly 70. As such, the clutch (e.g., clutch mechanism) of the winch may include the clutch pins 228, leaf springs 224 and 226, and dial (e.g., clutch lock). The leaf springs 224 and 226 may be mounted to an interior of the clutch dial 162 via screws 229. The fixed ring gear 216 is located within the clutch housing 222. Further, the leaf springs 224 and 226 may be coupled to the clutch housing 222 via the clutch pins 228.

The spring pins 228 each include a return spring. For example, by rotating the dial 162, the spring pins 228 are retracted by the returns springs. The return springs provide a minimal retraction force on the spring pins 228 and therefore limit the load under which the winch can be shifted into the free-spool position. For example, the load limit may be set to be no greater than 3% of the winch capacity rating. In this way, the clutch cannot be disengaged (e.g., moved into the free-spool mode) when a load above a threshold load (as determined by the stiffness of the return springs) is being applied to the winch. Upon reengagement of the clutch (e.g., the fixed ring gear 216), the leaf springs 224 and 226 deflect if the clutch pins 228 are not aligned with the corresponding grooves in the fixed ring gear 216. This allows the engagement to be delayed until they are aligned. Alignment occurs when the notches in the fixed ring gear 216 align with the clutch pins 228. When the clutch pins 228 align with the fixed ring gear notches the pins drop into the fixed ring gear notches effectively locking the fixed ring gear 216. When the fixed ring gear 216 is locked the geartrain is engaged and therefore the tool can again pull.

FIG. 3 also includes the plurality of tie rods 112 which in the depicted example are two in number. As described earlier in reference to FIGS. 1 and 2, plurality of rods 112 may be positioned at the bottom surface of winch assembly 70. To elaborate, plurality of tie rods 112 can be positioned below bottom side 173 of spool 175 of winch drum 170. Bottom side 173 of spool 175 is opposite to the top side 176 of spool 175, the top side 176 being closer to window 124 (and the handle 122) than the bottom side 173. An internal support 118 may also be included within winch assembly 70. In one example, internal support 118 may be shaped similar to tie rods 112 and may be a rod-like cylindrical structure. Other shapes for internal support 118 have been contemplated. Unlike plurality of tie rods 112, internal support 118 may be coupled to first end housing 110 and second end housing 120 towards the top of winch assembly 70. Internal support 118 may be situated closer to handle 122 and window 124 than plurality of tie rods 112. As such, internal support 118 may not be positioned below bottom side 173 of spool 175 of winch drum 170. Further, internal support 118 may be located on a side of winch assembly 70 that is opposite to fairlead 150 relative to axis of rotation 85. Internal support 118 may function as an additional brace to a frame of winch assembly 70. In alternate embodiments, the winch 70 may not include the internal support 118.

A shield 272 to protect winch drum 170 from debris is also portrayed at the extreme right hand side of FIG. 3. Shield 272 may be coupled to first end housing 110 within central circular opening of rear circular frame end 140. Fairlead 150, as mentioned earlier, may be a distinct structural piece of winch assembly 70, the fairlead 150 defining a distance between an exterior wall of first end housing 110 and an exterior wall of second end housing 120.

As illustrated in FIG. 3, first end housing 110 may cap winch drum 170 at a first side towards first flange 171 while second end housing 120 may cap winch drum 170 at a second side towards second flange 172. Further, the first side and the second side may be located opposite each other. To elaborate, first flange 171 and second flange 172 are positioned opposite each other.

It will also be appreciated that an internal motor (or another type of internal power source) is not included within winch assembly 70. Therefore, operation of the winch 70 may not be possible without an external actuator. Accordingly, torque to drive the winch assembly 70 may only be provided via external actuation to the externally actuatable input drive shaft 264.

O-ring 292 may enable sealing between winch drum 170 and first end housing 110. Further, O-ring 292 may reduce water and dust intrusion into the winch assembly 70. Additional seals as well as other components may also be incorporated in winch assembly 70 without departing from the scope of the present disclosure. For example, an additional O-ring (e.g., O-ring 299 shown in FIG. 7) may be positioned within an O-ring groove 297 in the first end housing 110. It will be noted that winch assembly 70 may include additional components shown in FIG. 3 that are not described in this disclosure. As an example, a cable or wire rope may be wound onto winch drum 170 within winch assembly 70 that is not depicted in any of the figures.

Turning now to FIG. 4, a perspective view of torque-limiting device 250 is illustrated herein. Torque-limiting device 250 may comprise torque-limiting mechanism 251, compression spring 256, and spring cap 274. Torque-limiting mechanism 251 may include a first cam 252 and a second cam 254. The first cam 252 may be termed a driver cam since input drive shaft 264 may be fitted into, and drive, the first cam 252. First cam 252 may be interlocked with second cam 254. Each of the first cam 252 and the second cam 254 may be formed with ramps that oppose each other. Specifically, ramps 452 formed on a first mating surface 294 of first cam 252 may interlock with opposing ramps 454 formed on a second mating surface 296 of second cam 254. First mating surface 294 of first cam 252 may face second mating surface 296 of second cam 254, as shown. Ramps 452 and ramps 454 may have opposing angles. Further, ramps 452 and 454 may be formed with specific angles based on a desired torque overload limit. As an example, the angles of ramps 452 and 454 may be different for a lower limit of torque overload than angles chosen for a higher torque overload limit.

First cam 252 may, thus, intermesh with second cam 254 via ramps 452 and 454. Further, first cam 252 may be pressed against second cam 254 by compression spring 256 which may be held by spring cap 274. As such, compression spring 256 presses directly against first cam 252. First cam 252 may press against second cam 254 with a force that may be determined by a spring constant of compression spring 256. In one example, compression spring may be further loaded by twisting a pair of jam nuts 268 against spring cap 274. Thus, first cam 252 may be interlocked with second cam 254 at a pressure dependent upon a load from jam nuts 268. In this example, torque-limiting device 250 may include torque-limiting mechanism 251, with first cam 252 and second cam 254, compression spring 256, spring cap 274, and jam nuts 268. In other examples, jam nuts 268 may not be included and first cam 252 and second cam 254 may be forced together at a pressure based only on the spring constant of compression spring 256.

Torque may be transmitted from input drive shaft 264 to first cam 252 and thereon, to second cam 254. If the torque driving first cam 252 exceeds a specific design factor, first cam 252 may ramp up and over ramps 454 of second cam 254. The specific design factor may be a predetermined torque threshold (e.g., also referred to herein as a load limit or threshold). As such, the first cam 252 may be decoupled from second cam 254 when the predetermined torque threshold is exceeded. The torque-limiting capacity of the torque-limiting device 250 may be a function of ramp angles in the two cams, surface area that is interlocked between the two cams, material of the cams, cam height, friction between cam surfaces and spring force of compression spring 256. Upon exceeding the predetermined torque threshold, first cam 252 may separate from second cam 254 and may be forced axially towards compression spring 256. After a decoupling event the force provided by compression spring 256 forces first cam 252 to reengage with second cam 254 and allow torque transfer from input drive shaft 264 to output driven shaft 262.

Spring cap 274, compression spring 256, and jam nuts 268 (if present) may be mounted on first end 266 (not shown in FIG. 4) of input drive shaft 264 that includes a splined portion. First cam 252 may also be mounted on the splined portion of input drive shaft 264. As such, first end 266 of input drive shaft 264 may be splined to reduce friction from axial movement of first cam 252 as it decouples from second cam 254 during a torque overload condition.

As shown in FIG. 4, needle bearing 258 may be mounted on output driven shaft 262 adjoining second cam 254. Needle bearing 258 may be a thrust bearing to resist thrust forces received from second cam 254. Output driven shaft 262 may be further mounted in a bushing 276 which is positioned adjacent to needle bearing 258. Output driven shaft 262 may rotate within and be supported by needle bearing 258 and bushing 276. As will be observed n FIG. 5, needle bearing 258 and bushing 276 may be supported by winch drum 170. An output end 261 of output driven shaft 262 may be coupled to input (e.g. sun gear 214) of transmission 210. The needle bearing 258 allows the torque limiting mechanism 251 to rotate relative to the winch drum while axial thrust is generated by compression of spring 256. As such, friction from axial forces produced along the torque limiting mechanism 251 are reduced, thereby allowing various speed differentials.

FIG. 5 portrays a sectional view 500 of winch drum 170 indicating a positioning of input drive shaft 264, torque-limiting device 250, and output driven shaft 262 within spool 175 of winch drum 170.

Winch drum 170 may be at least partially hollow to accommodate torque-limiting device 250 as well as input drive shaft 264 and output driven shaft 262. Each of input drive shaft 264 and output driven shaft 262 may protrude beyond first flange 171 and second flange 172 respectively, of winch drum 170. Specifically, second end 282 of input drive shaft 264 may extend beyond first flange 171 such that it is exposed towards rear end of winch assembly 70 to enable coupling to an externally actuating device. However, torque-limiting device 250 may be completely enclosed within spool 175 of winch drum 170. To elaborate, torque-limiting device 250 may not protrude beyond either first flange 171 or second flange 172 of winch drum 170. Further, input drive shaft 264, torque-limiting device 250, and output driven shaft 262 may be situated in an axial direction of the winch drum 170 (e.g., in a direction of the axis of rotation 85 of the winch). Further still, input drive shaft 264, torque-limiting device 250, and output driven shaft 262 may be situated along a centrally axial direction of the winch drum 170.

Sectional view 500 of FIG. 5 also depicts the positioning of torque-limiting device 250 in between input drive shaft 264 and output driven shaft 262. As described earlier in reference to FIG. 4, torque-limiting device 250 may include torque-limiting mechanism 251, with first cam 252 and second cam 254, compression spring 256, and spring cap 274. Some embodiments may also include jam nuts 268 (not shown in FIG. 5) situated adjacent to spring cap 274. As elaborated earlier, first cam 252 and second cam 254 may be interlocked with each other via opposing ramps. One set of ramps 454 on second mating surface 296 of second cam 254 can be observed in sectional view 500 locked into a valley 295 on first mating surface 294 of first cam 252.

Output driven shaft 262 may rotate within needle bearing 258 and bushing 276. Each of needle bearing 258 and bushing 276 may be held by winch drum 170. Thus, at least a portion of output driven shaft 262 may be supported by winch drum 170. Splined teeth 208 (or plurality of teeth 208) may be cast onto output end 177 of winch drum 170 for meshing with rotatable ring gear 218 of transmission 210.

Turning now to FIGS. 6 and 7, they portray a front view 600 of winch assembly 70 as viewed from its front end, and a sectional view 700. Sectional view 700 is a cross-sectional view of winch assembly 70 in a cross sectional plane along line A-A of FIG. 6. Sectional view 700 further shows a cross sectional view along the length of winch assembly 70 from its front end to its rear end.

An anchor fixture 126 is depicted on a side in front view 600. It will be noted that anchor fixture 126, in the depicted example, is located on the side opposite fairlead 150 (e.g., opposite with respect to the winch drum). Anchor fixture 126 may be used to attach portable winch 70 to an external support via a hook, strap, wire rope, cable, or other means. Anchor fixture 126 may thus provide an additional mode, other than plurality of tie rods 112, to attach winch assembly 70 to an external support.

Dial 162 on front circular frame end 160 of second end housing 120 is also shown in FIG. 6. It will be appreciated from front view 600 that dial 162 may be rotated between locked position 164 and unlocked position 166 to lock and unlock the transmission 210 for restraining or allowing reverse rotation. In the locked position, winch assembly 70 may hold static load when the external actuator is inoperative. In the unlocked position, winch assembly 70 may be rotated in a reverse direction (e.g. reverse to direction when winding or retracting a cable) to unwind the cable.

Front view 600 also depicts handle 122 of winch assembly 70 that enables winch 70 to be used as a handheld device. Handle 122, as described earlier in reference to FIGS. 1 and 2, may be positioned towards the top of winch assembly 70, opposite to the bottom surface of winch assembly 70. Handle 122 may be a cylindrical shaped structure with top flat portion 123 opposite the series of ridges 125 (or finger holds 125). Ridges 125 may be fashioned as grooves to enable fitting to a user's fingers. Also, as described earlier in reference to FIG. 1, handle 122 may be coupled in-between first inclined portion 132 and second inclined portion 134. First inclined portion 132 and second inclined portion 134 may be formed by coupling first end housing 110 and second end housing 120 to each other.

Handle 122 may be attached to first inclined portion 132 at first end 136 and may be attached to second inclined portion 134 at second end 138. First inclined portion 132 and second inclined portion 134 may be inclined in a direction parallel to each other and parallel to centerline 80. Further, first inclined portion 132 may angle away from second inclined portion 134 while second inclined portion 134 may be inclined towards first inclined portion 132. As such, each of first inclined portion 132 and second inclined portion 134 incline away from fairlead 150. Further, each of first inclined portion 132 and second inclined portion 134 incline towards anchor fixture 126. Handle 122 may also extend along a width of the end housings 110 and 120.

Window 124 is also depicted coupled towards the top of winch assembly 70. Window 124 may be positioned underneath handle 122. Further, window 124 may be located vertically above the winch drum 170 to observe spooling of the cable onto winch drum 170.

Sectional view 700 in FIG. 7 includes sectional view of winch drum 170 as well as sectional views of the two end housings 110, 120, and additional components that form the framework of winch assembly 70.

As described earlier in reference to FIGS. 3-6, winch assembly 70 may include first end housing 110 and a second end housing 120. Winch drum 170 may be positioned in an intermediate location between first end housing 110 and second end housing 120. Specifically, first end housing 110 may cap (e.g., enclose) a first side of winch drum 170 and second end housing 120 may cap (e.g., enclose) a second side of the winch drum 170. To elaborate further, rear circular frame end 140 of first end housing 110 may cap winch drum 170 towards the rear of winch assembly 70. Further, front circular frame end 160 of second end housing 120 may cap winch drum 170 towards the front of winch assembly 70. As such, the first end housing 110 and second end housing 120 may fully enclose the internal components of winch assembly 70.

Externally actuatable input drive shaft 264, torque-limiting device 250, and output driven shaft 262 may be positioned in a central axial position within winch drum 170 and winch assembly 70, along axis of rotation 85 of the winch. Second end 282 of externally actuatable input drive shaft 264 may project slightly beyond rear circular frame end 140. Output end 261 of output driven shaft 262 may be coupled to sun gear 214 of transmission 210. As such, output end 261 may be fitted into sun gear 214. Further, each of the plurality of planet gears 212 may mesh with sun gear 214 and with ring gear 218. Ring gear 218 may not be fixed and may rotate to transmit rotational motion from planet gears 212 to winch drum 170 via splined teeth 208 on output end 177 of winch drum 170.

By positioning torque-limiting device 250 in-between input drive shaft 264 and output driven shaft 262, torque-limiting features of winch assembly 70 may be enhanced. Torque-limiting device 250 may comprise torque-limiting mechanism 251 (including first cam 252 and second cam 254), compression spring 256, and spring cap 274. In some embodiments, torque-limiting device 250 may also include jam nuts 268 to provide additional load on first cam 252 and second cam 254.

It will be appreciated that torque-limiting device 250 provided within winch assembly 70 may be in addition to a torque limiter that may be present in the external actuator. Thus, operation of the winch assembly 70 may be enhanced.

Sectional view 700 also depicts one of the plurality of tie rods 112 extending between first end housing 110 and second end housing 120. Tie rod 112 may be positioned towards a first side (e.g. bottom surface) of winch assembly 70. As will be observed, tie rod 112 is placed below or towards an underside of winch drum 170. Further still, a space "D" may be present between tie rod 112 (shown in FIG. 7) and underside of winch drum 170. Space "D" between tie rod 112 and base of winch drum 170 may allow easier access to the plurality of tie rods 112. Additionally, FIG. 7 depicts O-rings seals 292 and 299, as described above.

Thus, an assembly for a winch may include a winch drum having an output end, an externally actuatable input drive shaft, and an output driven shaft. A torque-limiting device may be positioned within the winch drum wherein the torque-limiting device included a torque-limiting mechanism situated between the externally actuatable input drive shaft and the output driven shaft. The assembly may further include a transmission which comprises an input and a ring gear. The input of the transmission may be coupled to the output driven shaft while the ring gear may be coupled to the output end of the winch drum. The externally actuatable input drive shaft may include a splined shaft at a first end wherein the first end is coupled to the torque-limiting mechanism.

The transmission may comprise a differential planetary gear train including the ring gear, the ring gear meshing with a plurality of teeth on the output end of the winch drum. The differential planetary gear train may have a higher resistance to being back-driven. Thus, the transmission in the assembly may not be back-drivable. Further, a cable wound onto the winch drum may be unwound by reversing rotation of the input drive shaft via external actuation. Alternatively, reverse rotation of the differential planetary gear train and winch drum may also be enabled by unlocking a fixed ring gear of the transmission.

In another example, a winch assembly may include a first end housing, a second end housing, and a winch drum, with splined teeth on an output end, positioned between the first end housing and the second end housing. An input drive shaft adaptable to being externally actuated and an output driven shaft driving a differential planetary gear train may also be included in the winch assembly. The differential planetary gear train may comprise a rotatable ring gear, the rotatable ring gear meshing with the splined teeth on the output end of the winch drum. Further, a torque-limiting device may be enclosed within the winch drum. The torque-limiting device may comprise a spring loaded cam mechanism and may be placed in-between the input drive shaft and the output driven shaft.

In yet another example, a winch assembly may comprise two end housings coupled to each other with a winch drum positioned within the two end housings, the winch drum including an output side. The winch assembly may further include a torque-limiting device positioned inside the winch drum. Further still, a plurality of tie rods may be coupled to the two end housings, the plurality of tie rods positioned around a first side of the winch drum. Additionally, a fairlead may be located between the two end housings and may be coupled to each of the two end housings.

In an additional example, an assembly for a winch may include a winch drum with an output side, and a torque-limiting device positioned inside the winch drum. The assembly may also include two end housings coupled to each other and wherein, the winch drum may be positioned within the two end housings. Additionally, a plurality of tie rods may be coupled to the two end housings, the plurality of tie rods positioned around a first side of the winch drum. Further still, a fairlead may be located between the two end housings and may be coupled to each of the two end housings.

In another embodiment, a winch may comprise a winch drum with an output side, a torque-limiting device positioned inside the winch drum, and a plurality of tie rods, the plurality of tie rods positioned around a first side of the winch drum. The winch may further include two end housings coupled to each other such that the winch drum may be positioned within the two end housings. Additionally, the plurality of tie rods may be coupled to the two end housings. Further still, a fairlead may be located between the two end housings and may be coupled to each of the two end housings.

In yet another embodiment, an assembly may comprise a winch drum positioned within two end housings, and a plurality of tie rods, the plurality of tie rods positioned around a first side of the winch drum. The two end housings may be coupled to each other. Further, the plurality of tie rods may be coupled to the two end housings. The assembly may further include a torque-limiting device positioned inside the winch drum. Further still, a fairlead may be located between the two end housings and may be coupled to each of the two end housings.

In an additional embodiment, an assembly may comprise two end housings coupled to each other, a winch drum positioned within the two end housings, a torque limiting device positioned inside the winch drum, and a plurality of tie rods coupled to the two end housings, the plurality of tie rods positioned around a first side of the winch drum. The assembly may further include a fairlead located between the two end housings and coupled to each of the two end housings.

In a further embodiment, an assembly may comprise two end housings coupled to each other, a winch drum positioned within the two end housings, a torque limiting device positioned inside the winch drum, and a fairlead located between the two end housings and coupled to each of the two end housings. The assembly may further include a plurality of tie rods coupled to the two end housings, the plurality of tie rods positioned around a first side of the winch drum.

In a different example, a winch may comprise a winch drum, an externally actuatable input shaft, and an output driven shaft. The winch may further include a torque-limiting device positioned within the winch drum. Furthermore, the torque-limiting device may comprise a torque-limiting mechanism situated between the externally actuatable input shaft and the output driven shaft. Further still, the winch may include a transmission including an input and a ring gear, the input coupled to the output driven shaft and the ring gear coupled to an output end of the winch drum.

In another different example, an assembly may comprise a winch drum, an externally actuatable input shaft, an output driven shaft, and a torque-limiting device. The torque-limiting device may be positioned within the winch drum. The torque-limiting device may further comprise a torque-limiting mechanism situated between the externally actuatable input shaft and the output driven shaft. Further still, the winch may include a transmission including an input and a ring gear, the input coupled to the output driven shaft and the ring gear coupled to an output end of the winch drum.

In yet another different example, an assembly may comprise a winch drum, an externally actuatable input shaft, an output driven shaft, and a transmission including an input and a ring gear, the input coupled to the output driven shaft and the ring gear coupled to an output end of the winch drum. The winch may further include a torque-limiting device positioned within the winch drum. Furthermore, the torque-limiting device may comprise a torque-limiting mechanism situated between the externally actuatable input shaft and the output driven shaft.

In a different embodiment, an assembly may comprise a winch drum, an externally actuatable input shaft, an output driven shaft, and a transmission. The transmission may include an input and a ring gear, the input coupled to the output driven shaft and the ring gear coupled to an output end of the winch drum. The winch may further include a torque-limiting device positioned within the winch drum. Furthermore, the torque-limiting device may comprise a torque-limiting mechanism situated between the externally actuatable input shaft and the output driven shaft.

In a further embodiment, an assembly may comprise a winch drum, and a transmission. The assembly may also include an externally actuatable input shaft, an output driven shaft. The transmission may include an input and a ring gear, the input coupled to the output driven shaft and the ring gear coupled to an output end of the winch drum. The winch may further include a torque-limiting device positioned within the winch drum. Furthermore, the torque-limiting device may comprise a torque-limiting mechanism situated between the externally actuatable input shaft and the output driven shaft.

In yet another embodiment, a winch assembly may comprise a first end housing, a second end housing, a winch drum, with splined teeth on an output end, positioned between the first end housing and the second end housing, an input drive shaft adaptable to being externally actuated, and an output driven shaft driving a differential planetary gear train. The differential planetary gear train may comprise a rotatable ring gear, the rotatable ring gear meshing with the splined teeth on the output end of the winch drum. The winch assembly may further include a torque-limiting device enclosed within the winch drum and comprising a spring loaded cam mechanism, the torque-limiting device placed in between the input drive shaft and the output driven shaft.

In a different example, a winch assembly may comprise a winch drum, with splined teeth on one end, positioned between a first end housing and a second end housing, an input drive shaft adaptable to being externally actuated, and an output driven shaft. The winch assembly may further include a differential planetary gear train being driven by the output driven shaft. The differential planetary gear train may comprise a rotatable ring gear, the rotatable ring gear meshing with the splined teeth on the one end of the winch drum. The winch assembly may further include a torque-limiting device enclosed within the winch drum and comprising a spring loaded cam mechanism, the torque-limiting device placed in between the input drive shaft and the output driven shaft.

In another different example, an assembly may comprise a winch drum, with splined teeth on one end, an input drive shaft adaptable to being externally actuated, and an output driven shaft. The assembly may further include a differential planetary gear train being driven by the output driven shaft. The differential planetary gear train may comprise a rotatable ring gear, the rotatable ring gear meshing with the splined teeth on the one end of the winch drum. The assembly may further include a torque-limiting device enclosed within the winch drum and comprising a spring loaded cam mechanism, the torque-limiting device placed in between the input drive shaft and the output driven shaft. The assembly may also include a first end housing and a second end housing such that the winch drum with splined teeth may be positioned between the first end housing and the second end housing.

In this way, a pulling tool assembly (such as a winch) may be actuated by an external actuator. A torque provided by the external actuator may be amplified by the differential planetary gear transmission. A torque limiter may be included to ensure that torque provided to the winch assembly does not exceed a threshold. Further, a likelihood of mechanical degradation due to torque overload may be reduced. The pulling tool assembly may be operated as a handheld device. Alternatively, the pulling tool assembly may be hooked or attached to an external support, when desired, via the plurality of tie rods.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A pulling tool, comprising:

a drum having an output end;

an externally actuatable input shaft;

an output driven shaft;

a torque-limiting device positioned within the drum, the torque-limiting device including a torque-limiting mechanism disposed between an end of the externally actuatable input shaft and an end of the output driven shaft, wherein the torque-limiting mechanism is co-axial with both the externally actuatable input shaft and the output driven shaft, wherein the torque-limiting mechanism includes a first cam and a second cam, wherein the first cam is disposed on the end of the externally actuatable input shaft and the second cam is disposed on the end of the output driven shaft, wherein the torque-limiting device includes a plurality of jam nuts configured to set a torque limit; and a transmission including an input and a ring gear, the input coupled to the output driven shaft and the ring gear coupled to the output end of the drum.

2. The pulling tool of claim 1, wherein a torque to drive the assembly via the externally actuatable input drive shaft is only provided by external actuation, and wherein the input shaft is drivable via the external actuation in a clockwise direction.

3. The pulling tool of claim 2, wherein the externally actuatable input drive shaft includes a splined shaft at a first end, the first end positioned internally within the drum.

4. The pulling tool of claim 2, further comprising a cable wound around the drum, wherein the cable winds off the drum from a top of the drum.

5. The pulling tool of claim 1, wherein the transmission is not back-drivable.

6. The pulling tool of claim 5, wherein the transmission comprises a differential planetary gear train including the ring gear, the ring gear meshing with a plurality of teeth on the output end of the drum.

7. The pulling tool of claim 1, further comprising a first end housing capping the drum at a first side, a second end housing capping the drum at a second side, the first side and the second side being opposite each other relative to a centerline of the pulling tool, where the centerline is perpendicular to an axis of rotation of the drum.

8. The pulling tool of claim 7, further comprising a plurality of tie rods coupled to and extending between the first end housing and the second end-housing, wherein the plurality of tie rods spaced away from each other and wherein the plurality of tie rods are positioned a distance away from a bottom side of a spool of the drum.

9. The pulling tool of claim 1, wherein at least a portion of the output driven shaft is supported by the drum and wherein the first cam and the second cam are interlocked together by a compression spring, the compression spring pressing against the first cam.

10. A pulling tool, comprising:

a drum including a first flange and a second flange, wherein a plurality of splined teeth is disposed along an outer circumference of one of the first flange and the second flange of the drum at an output end of the drum;

an externally actuated input drive shaft driving an output driven shaft;

a differential planetary transmission driven by the output driven shaft and including a rotatable ring gear meshing with the splined teeth and including a fixed ring gear; and a clutch mechanism comprising:

a plurality of spring pins adapted to interface with corresponding grooves in the fixed ring gear; and a rotatable clutch lock, where the clutch lock is adapted to rotate and retract the plurality of spring pins out of engagement with the fixed clutch ring in order to enable free-spooling of the pulling tool.

11. The pulling tool of claim 10, wherein a driving torque is provided to the input drive shaft only by external actuation, and wherein an internal motor is not included within the pulling tool.

12. The pulling tool of claim 11, wherein at first end of the input drive shaft is splined and contained within an interior of the drum, wherein the output driven shaft is a d-shaft supported at least partially by the drum, and wherein a first end of the output driven shaft is contained within the interior of the drum.

13. The pulling tool of claim 12, wherein a second end of the input drive shaft extends outside of the drum to enable coupling to an external actuator and wherein a second end of the output driven shaft extends outside of the drum, on a side of the drum opposite that which the input drive shaft extends outside of, where the second end of the output driven shaft engages with sun gear of the differential planetary transmission.

14. A pulling tool, comprising:

a drum including a first flange and a second flange, wherein a plurality of splined teeth is disposed along an outer circumference of one of the first flange and the second flange of the drum at an output end of the drum;

an input drive shaft adapted to be externally actuated;

an output driven shaft driven by the input drive shaft and driving a differential planetary gear train, the differential planetary gear train comprising a rotatable ring gear meshing with the splined teeth and a fixed ring gear; and a clutch mechanism comprising:

a plurality of spring pins adapted to interface with corresponding grooves in the fixed ring gear, each of the plurality of spring pins including a return spring that provides a refraction force on a corresponding spring pin of the plurality of spring pins; and a rotatable clutch lock, where the clutch lock is adapted to rotate and retract the plurality of spring pins out of engagement with the fixed clutch ring in order to enable free-spooling of the pulling tool only when a load on the pulling tool is less than a threshold load, where the threshold load is based on the retraction force of the return springs.

15. The pulling tool of claim 14, further comprising a torque-limiting device enclosed within the drum and comprising a spring loaded cam mechanism, the torque-limiting device placed in between the input drive shaft and the output driven shaft and wherein the differential planetary gear train is not back-drivable.

* * * * *